US007369799B2

(12) United States Patent
Ishii

(10) Patent No.: US 7,369,799 B2
(45) Date of Patent: May 6, 2008

(54) DEVELOPING CARTRIDGE AND IMAGE FORMING APPARATUS

(75) Inventor: Masahiro Ishii, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 278 days.

(21) Appl. No.: 11/341,708

(22) Filed: Jan. 30, 2006

(65) Prior Publication Data

US 2006/0171747 A1 Aug. 3, 2006

(30) Foreign Application Priority Data

Jan. 31, 2005 (JP) ..... 2005-024193

(51) Int. Cl.
*G03G 15/08* (2006.01)

(52) U.S. Cl. ..... 399/284; 399/27

(58) Field of Classification Search ..... 399/274, 399/284, 273, 283, 27
See application file for complete search history.

(56) References Cited

U.S. PATENT DOCUMENTS

| | | | | |
|---|---|---|---|---|
| 4,395,110 | A * | 7/1983 | Hosono et al. | 399/284 |
| 5,708,943 | A * | 1/1998 | Applegate et al. | 399/284 |
| 5,768,670 | A * | 6/1998 | Enomoto et al. | 399/284 |
| 6,516,174 | B1 * | 2/2003 | Aoki et al. | 399/284 |
| 6,978,100 | B2 * | 12/2005 | Yasui et al. | 399/284 |
| 2004/0134560 | A1 | 7/2004 | Sato et al. | |

FOREIGN PATENT DOCUMENTS

| | | | |
|---|---|---|---|
| JP | 5-27569 | A | 2/1993 |
| JP | 6-295120 | A | 10/1994 |
| JP | 8-44191 | A | 2/1996 |
| JP | 11-194609 | A | 7/1999 |
| JP | 2004-37779 | A | 2/2004 |
| JP | 2004-133205 | A | 4/2004 |
| JP | 2005-24193 | A | 1/2005 |

* cited by examiner

*Primary Examiner*—Susan Lee
(74) *Attorney, Agent, or Firm*—McDermott Will & Emery LLP

(57) ABSTRACT

A layer thickness restricting blade may include an arm main body and a contact portion provided at a front end portion of the arm main body. The contact portion may be configured by inserting a rubber member made of polyurethane to a rubber member made of silicone. The contact portion may be brought into contact with a surface of a developing roller and be gradually worn in accordance with rotation of the developing roller. When a revolution number of the developing roller reaches a rectified revolution number, a polyurethane layer at inside thereof may be exposed to a surface. Thereby, a failure in charging may be brought about in a toner at the portion, further, a failure in an image may be brought about on a sheet and therefore, by bringing about the failure in the image, an operator may be informed that a timing of interchanging the toner is reached.

12 Claims, 16 Drawing Sheets

DEVELOPING CARTRIDGE AND IMAGE FORMING APPARATUS

CROSS REFERENCE TO RELATED APPLICATION

This application claims priority from Japanese Patent Application No. 2005-024193 filed on Jan. 31, 2005, the entire subject matter of which is incorporated herein by reference.

TECHNICAL FIELD

The present invention may relate to a developing cartridge used in a developing method of an electronic photography system and an image forming apparatus using the developing cartridge.

BACKGROUND

In a background art, there is widely known a developing method for developing an electrostatic latent image formed on a surface of a photosensitive drum by a developer agent (toner) (for example, see JP-A-2004-037779).

According to the developing method, a toner is charged by friction by a supply roller and a layer thickness restricting blade and thereafter, adhered to a surface of the developing roller in a state of being formed into a thin layer. Further, by generating an electric field by applying a developing bias voltage to the developing roller, the charged toner is made to adhere to a portion formed with the electrostatic latent image. Further, the toner adhered to the electrostatic latent image portion is transcribed onto a sheet and a desired image is formed on the sheet by bringing the toner into press contact therewith by a fixer.

On the other hand, the toner adhered onto the developing roller which is not used for development is returned again to a toner hopper and is agitated with the toner remaining in the toner hopper by an agitator. Further, when the development is carried again, the toner is charged by friction by the supply roller and the layer thickness restricting blade and thereafter adhered to the surface of the developing roller.

In this way, the toner is repeatedly subjected to successive cycles of friction charging->adhering to the developing roller->returning to the toner hopper->friction charging and therefore, with an increase in a number of times of development, the toner is gradually deteriorated to be difficult to be charged, since in the above-described developing method, development is carried out by utilizing operation of a force which an electric charge (charged toner) receives from the electric field, when an amount of charging the toner is reduced, the development cannot excellently be carried out and an image quality is deteriorated. In order to prevent the deterioration in the image quality beforehand, prior to deteriorating the toner, the toner and therefore, the developing cartridge (having the developing roller, the supply roller, the layer thickness restricting blade, the toner hopper and the like) may be interchanged by informing the deterioration of the toner to an operator and in order to realize the interchange, for example, a counter for counting a revolution number of the developing roller may be provided at an apparatus main body and when the revolution number reaches a predetermined rectified number of times, a timing of interchanging the toner may be displayed.

However, according to the above-described configuration, the counter is needed and therefore, a number of parts is increased and when the counter is failed, even when the developing roller reaches the rectified number of times, the timing of interchanging the toner is not displayed and the operator continues printing by the deteriorated toner.

SUMMARY

One aspect of the present invention may provide a developing cartridge capable of informing a timing of interchanging a toner to an operator by a comparatively simple configuration.

A developing cartridge may attachable to and detachable from an image forming apparatus that forms an image on a recording medium. The developing cartridge may include: a developer agent chamber that stores a developer agent of a nonmagnetic single component; a developer agent carrier that supplies the developer agent to an electrostatic latent image formed on an image carrier provided in the image forming apparatus; and a layer thickness restricting member that has a contact portion that elastically contacts with the developer agent carrier and restricts a layer thickness of the developer agent carried on the developer agent carrier. The contact portion includes a first layer that contacts with the developer agent carrier and a second layer covered by the first layer, the second layer being configured to be exposed by wearing of the first layer in accordance with rotation of the developer agent carrier and to be contacted with the developer agent carrier. The first layer is configured to charge the developer agent by a friction when the developer agent passes between the first layer and the developer agent carrier. The second layer is configured to cause the developer agent into a failure in charging when the developer agent passes between the second layer and the developing agent carrier.

A developing cartridge may attachable to and detachable from an image forming apparatus that forms an image on a recording medium. The developing cartridge may include: a developer agent chamber that stores a developer agent of a nonmagnetic single component; a developer agent carrier that supplies the developer agent to an electrostatic latent image formed on an image carrier provided in the image forming apparatus; and a layer thickness restricting member that has a contact portion that elastically contacts with the developer agent carrier and restricts a layer thickness of the developer agent carried on the developer agent carrier. The contact portion includes a first layer that contacts with the developer agent carrier and a second layer covered by the first layer, the second layer being configured to be exposed by wearing of the first layer in accordance with rotation of the developer agent carrier and to be contacted with the developer agent carrier. The first layer serves as a layer thickness restricting layer that restricts the layer thickness of the developer agent to become a predetermined regular layer thickness when the developer agent passes between the first layer and the developer agent carrier. The second layer serves as a releasing layer that releases the layer thickness from being restricted.

An image forming apparatus may include: an image forming section that forms an image on a recording medium, and is provided with an image carrier on which an electrostatic latent image is formed; and a developing cartridge attachable to and detachable from the image forming apparatus. The developing cartridge may include: a developer agent chamber that stores a developer agent of a nonmagnetic single component; a developer agent carrier that supplies the developer agent to the electrostatic latent image formed on the image carrier provided in the image forming apparatus; and a layer thickness restricting member that has a contact portion that elastically contacts with the developer agent carrier and restricts a layer thickness of the developer agent carried on the developer agent carrier. The contact portion includes a first layer that contacts with the developer agent carrier and a second layer covered by the first layer, the second layer being configured to be exposed by wearing of the first layer in accordance with rotation of the developer agent carrier and to be contacted with the developer agent carrier. The first layer is configured to charge the developer agent by a friction when the developer agent passes between the first layer and the developer agent carrier. The second layer is configured to cause the developer agent into a failure in charging when the developer agent passes between the second layer and the developing agent carrier.

An image forming apparatus may include: an image forming section that forms an image on a recording medium, and is provided with an image carrier on which an electrostatic latent image is formed; and a developing cartridge attachable to and detachable from the image forming apparatus. The developing cartridge may include: a developer agent chamber that stores a developer agent of a nonmagnetic single component; a developer agent carrier that supplies the developer agent to the electrostatic latent image formed on the image carrier provided in the image forming apparatus; and a layer thickness restricting member that has a contact portion that elastically contacts with the developer agent carrier and restricts a layer thickness of the developer agent carried on the developer agent carrier. The contact portion includes a first layer that contacts with the developer agent carrier and a second layer covered by the first layer, the second layer being configured to be exposed by wearing of the first layer in accordance with rotation of the developer agent carrier and to be contacted with the developer agent carrier. The first layer serves as a layer thickness restricting layer that restricts the layer thickness of the developer agent to become a predetermined regular layer thickness when the developer agent passes between the first layer and the developer agent carrier. The second layer serves as a releasing layer that releases the layer thickness from being restricted.

DETAILED DESCRIPTION

Illustrative aspects of the present invention will be described hereinbelow by reference to the drawings.

First Illustrative Aspect

A first illustrative aspect will be explained in reference to FIG. 1 through FIG. 12B.

Figure 1:
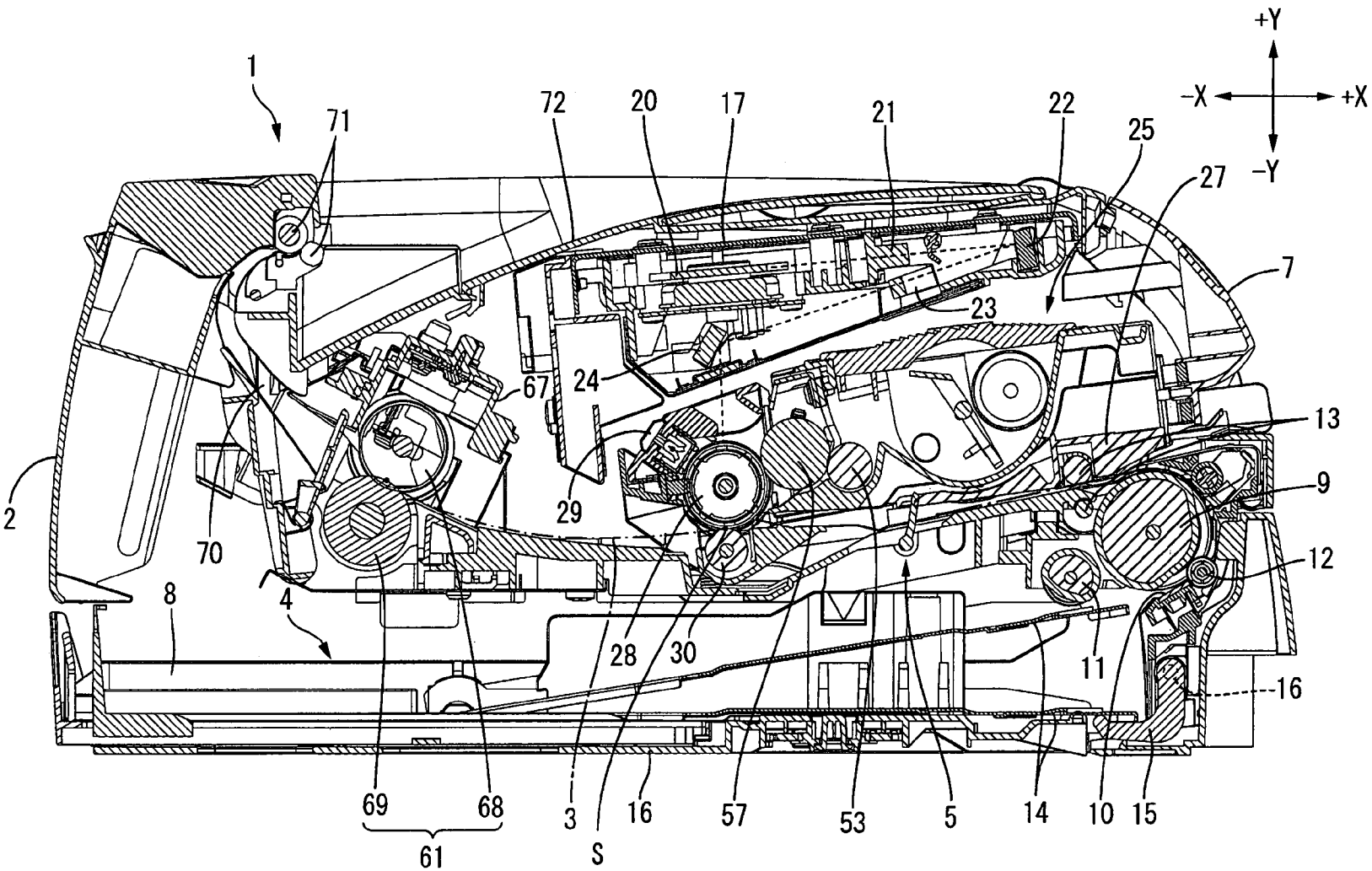
FIG. 1 is a side sectional view of an essential portion of a laser printer according to a first illustrative aspect.
Figure 2:
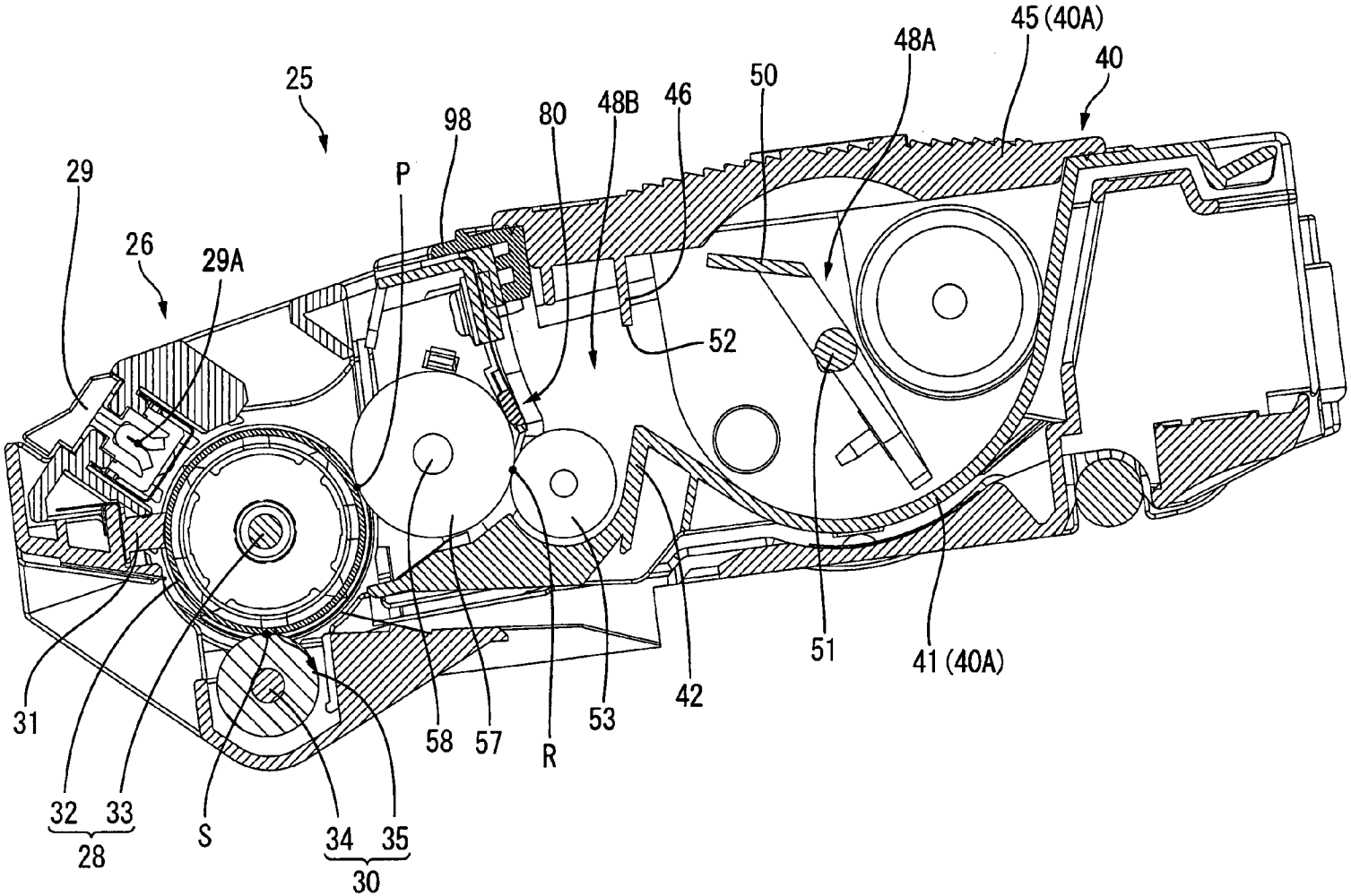
FIG. 2 is a side sectional view of a process cartridge.
Figure 3:
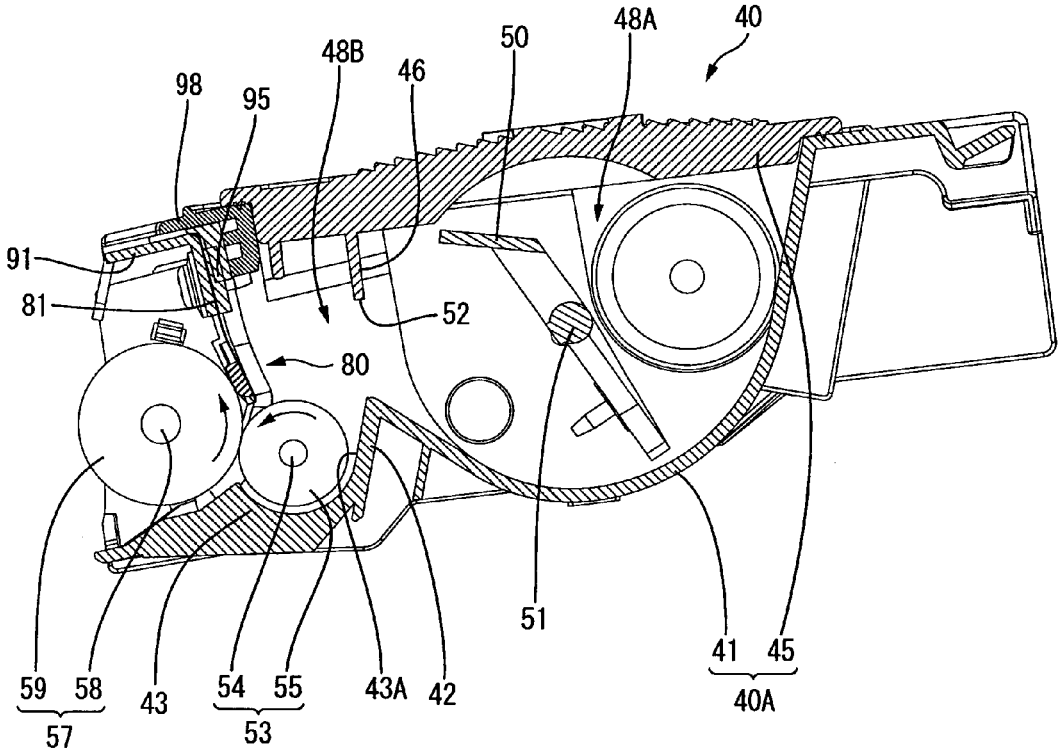
FIG. 3 is a side sectional view of a developing cartridge.
Figure 4:
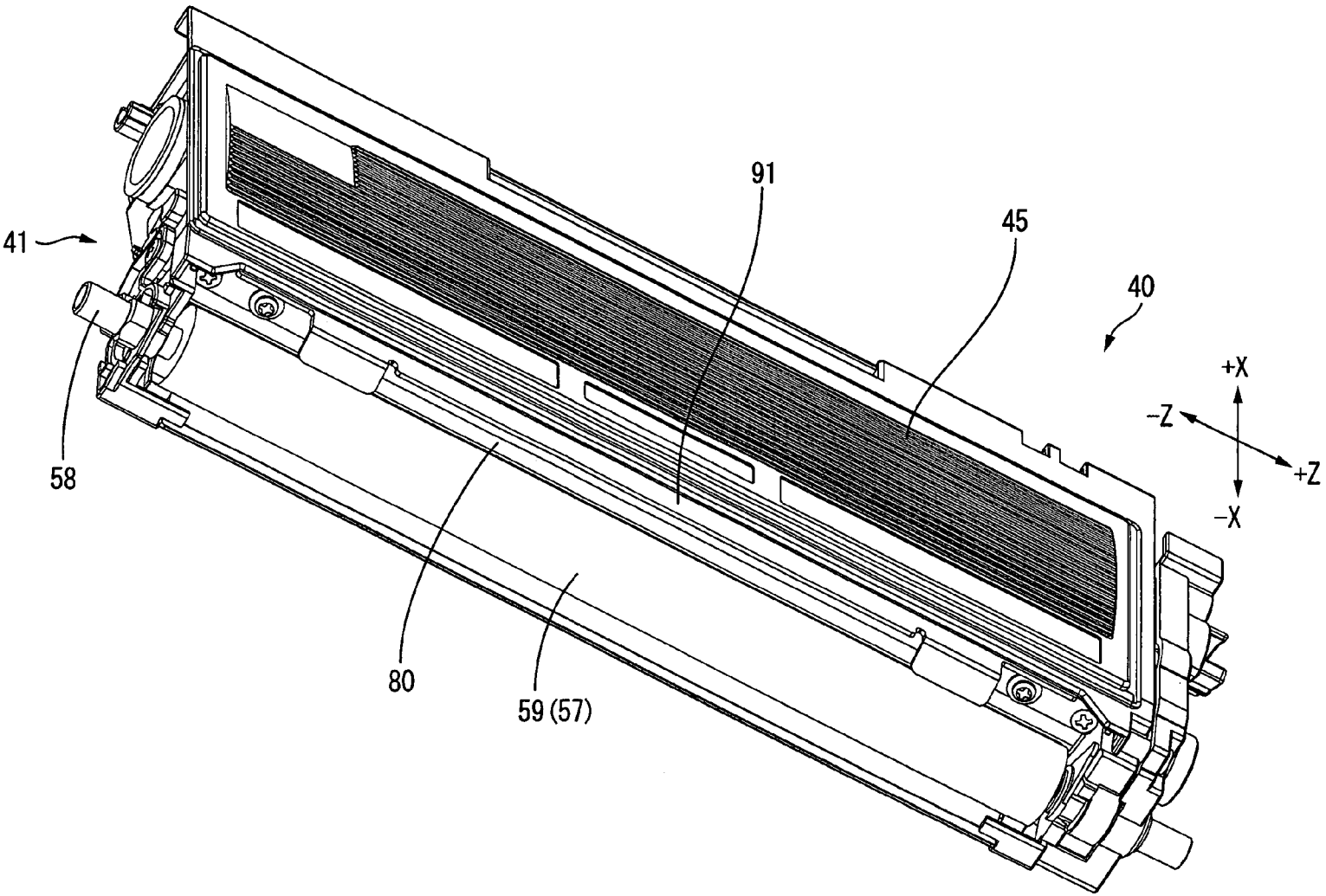
FIG. 4 is a perspective view viewing the developing cartridge from a rear side.

FIG. 1 is a side sectional view of an essential portion showing a laser printer as an image forming apparatus of the invention. FIG. 2 is a side sectional view of a process cartridge and FIG. 3 is a side sectional view of a developing cartridge. Further, in the following explanation, an explanation will be given by setting a depth direction of a laser printer 1 as X direction (a front face side thereof is set to +X), setting a width direction (a right hand side in FIG. 4 is set to +Z) as Z direction and setting a height direction as Y direction (an upper side of FIG. 1 is set to +Y).

The laser printer 1 is provided with a feeder portion 4 for supplying a sheet 3 to inside of a main body casing 2, an image forming section 5 of forming an image on the supplied sheet 3 and the like.

A front cover 7 is provided to a front wall of a main body casing 2. The front cover 7 is pivotably supported by a cover shaft, an attaching and detaching port provided at the front face wall of the main body casing 2 is opened by carrying out predetermined opening operation and a process cartridge 25, mentioned later, is made to be able to be detached by way of the attaching and detaching port.

The feeder portion 4 is configured by including a sheet feeding tray 8 mounted attachably and detachably to and from a bottom portion of inside of the main body casing 2, a sheet feeding roller 9 provided on an upper side of a front end portion of the sheet feeding tray 8, a sheet feeding pad 10, a pickup roller 11 provided on a rear side of the sheet feeding roller 9, a pinch roller arranged to be opposed to the sheet feeding roller 9 at a lower portion of a front side thereof and a registration roller 13 provided on an upper side of a rear side of the sheet feeding roller 9.

Inside of the sheet feeding tray 8 is provided with a sheet pressing plate 14 capable of mounting sheets in a laminated state. The sheet pressing plate 14 is fixed such that a front end side thereof is made to be pivotable. Further, a front end portion of the sheet feeding tray 8 is provided with a lever 15 for lifting the front end portion of the sheet pressing plate 14 to an upper side. The lever 15 is configured by a shape of being extended from a front side to a lower side of the sheet pressing plate 14, an upper end portion thereof is supported by a lever shaft 16 provided at a front end portion of the sheet feeding tray 8, and a rear end portion thereof is set to be brought into contact with a front end portion of a lower face of the sheet pressing plate 14. Therefore, when a force in a pivoting direction is inputted to the lever shaft 16, the lever 15 is pivoted by a fulcrum by the lever shaft 16 and the rear end portion of the lever 16 lifts the front end of the sheet pressing plate 14.

When the front end portion of the sheet pressing plate 14 is lifted, the sheet 3 disposed at a topmost position of the sheet pressing plate 14 is pressed to the pickup roller 11 and is carried to between the sheet feeding roller 9 and the sheet feeding pad 10 by rotating the pickup roller 11.

The sheet 3 carried to between the sheet feeding roller 9 and the sheet feeding pad 10 by the pickup roller 11 is fed by being separated sheet by sheet firmly when the sheet 3 is pinched between the sheet feeding roller 9 and the sheet feeding pad 10. The fed sheet 3 is carried to the registration roller 13 by passing between the sheet feeding roller 9 and the pinch roller 12. The registration roller 13 is configured by a pair of rollers to carry the sheet 3 to a transcribing position (nip position between a photosensitive drum 28 and a transcribing roller 30, mentioned later) S after registration.

The image forming section 5 is provided with a scanner portion 17, the process cartridge 25, a fixing portion 61 and the like.

The scanner portion 17 is provided at an upper portion of inside of the main body casing 2 and is provided with a laser light source, not illustrated, a polygonal mirror 20 driven to rotate, an fθ lens 21, a reflecting mirror 22, a lens 23 and a reflecting mirror 24 and the like. As shown by a chain line, a laser beam based on image data emitted from the laser light source is deflected by the polygonal mirror 20, passing through the fθ lens 21, thereafter, an optical path thereof is folded back by the reflecting mirror 22, the laser beam further passes through the lens 23 and irradiated onto a surface of the photosensitive drum, mentioned later, by flexing the optical path to a lower side by the reflecting mirror 24.

The process cartridge 25 is mounted attachably and detachably to and from the main body casing 2 on a lower side of the scanner portion 17. As shown by FIG. 2, the process cartridge 25 includes a drum cartridge 26 a developing cartridge 40. The drum cartridge 26 is configured by including the photosensitive drum (in correspondence with an image carrier of the invention) 28, a scoroton type charger 29, a transcribing roller 30 and a cleaning brush 31.

As shown by FIG. 3, the processing cartridge 40 is provided with a cabinet 40A, and is removably attached to the drum cartridge 26. The cabinet 40A is configured by a lower frame 41 opened in two directions of an upper direction and a rear direction (left side of FIG. 3) and an upper frame 45 for closing an upper face of an opening of the lower frame 41 to have a shape of a box opened to a rear side as a whole.

Whereas a partitioning plate 46 is formed downwardly at a position of a lower face wall of the upper frame 45 proximate to a rear portion, a bulging portion 42 is formed to bulge upward as illustrated at a position of the lower frame 41 opposed to the partitioning plate 46. Inside of the cabinet 40A is partitioned in a front and rear direction (left and right direction of FIG. 3) by the bulging portion 42 and the partitioning plate 46 and the inner space on a front side is made to constitute a toner storage chamber 48A.

The toner storage chamber 48A is filled with a toner T of a positively charging nonmagnetic single component. As a toner T, there is used a polymerized toner provided by polymerizing a polymerizing monomer, for example, styrene species monomer of styrene or the like, acrylic species monomer of acrylic acid, alkyl (C1 through C4) acrylate, alkyl (C1 through C4) metaacrylate or the like by suspension polymerization or the like. Such a polymerized toner constitutes substantially a spherical shape, having an extremely excellent fluidity and can achieve to form an image of a high image quality.

Further, the toner T is blended with a colorant of carbon black or the like, wax or the like and is added with an externally added agent of silica or the like to promote the fluidity. An average particle size of the toner T is about 6 through 10 μm.

An agitator 50 is arranged at a center of inside of the toner storage chamber 48A. The agitator 50 is supported by the cabinet 40A by way of a rotating shaft 51, driven to rotate by inputting power from a motor, not illustrated, and functions to agitate the toner T at inside of the toner storage chamber 48A. Further, in accordance with pivoting the agitator 50, the agitated toner T is discharged to a roller developer agent chamber 48B, mentioned later, by passing through a communicating port 52 formed between the partitioning plate 46 and the bulging portion 42.

An inner space of a rear portion side (left side of FIG. 3) in an inner space of the cabinet 40A is made to constitute the roller developer agent chamber 48B. A toner supply roller 53 is attached to a lower region of the roller developer agent chamber 48B and on a rear side of the communicating port 52. The toner supply roller 53 is configured by covering a roller shaft 54 made of a metal by a roller 55 comprising a conductive foamed material. The toner supply roller 53 is arranged in a state of being along a width direction of the developing cartridge 40 and two left and right end portions of the roller shaft 54 are supported by side walls of the cabinet 40A in a rotatable state.

A rear side of the toner supply roller 53 is arranged with a developing roller (in correspondence with a developer agent carrier of the invention) 57 constituted by covering a roller shaft (in correspondence with a rotating axis of the developer agent carrier of the invention) 58 by a roller main body 59 comprising a conductive cover material in parallel with the toner supply roller 53. Further specifically, a front end portion of the developing roller 57 is arranged in a state of being brought into contact to be compressed by the toner supply roller 53 and a rear portion there of is arranged to be brought into contact with the photosensitive drum 28, mentioned later. Further, a surface of the developing roller 57 is covered by a coating layer of silicone rubber including fluorine.

The two rollers 53, 57 are provided with gears at end portions of the shafts and when power from a motor, not illustrated, is inputted by way of the gears, the toner supply roller 53 is driven to rotate in a direction of moving the toner T discharged from the communicating port to a side of the developing roller 57, that is, in the counterclockwise direction shown in FIG. 3. On the other hand, the developing roller 57 is driven to rotate in the counterclockwise direction similar to the toner supply roller 53 to carry the toner T carried by the toner supply roller 53 to a layer thickness restricting blade (mentioned later) 80.

Further, the lower frame 41 constituting the cabinet 40A is formed with a bent portion 43 to surround lower portions of the developing roller 57 and the toner supply roller 53. The bent portion 43 holds a constant gap between the two rollers 53, 57 and the bent portion 43 to form a returning path 43A. One end (end portion on a right side of FIG. 3) of the returning path 43A is communicated with the roller developer agent chamber 48B and the toner T adhered to the developing roller 57 which is not used for development is returned to the roller developer agent chamber 48B and therefore, the toner storage chamber 48A.

Figure 5:
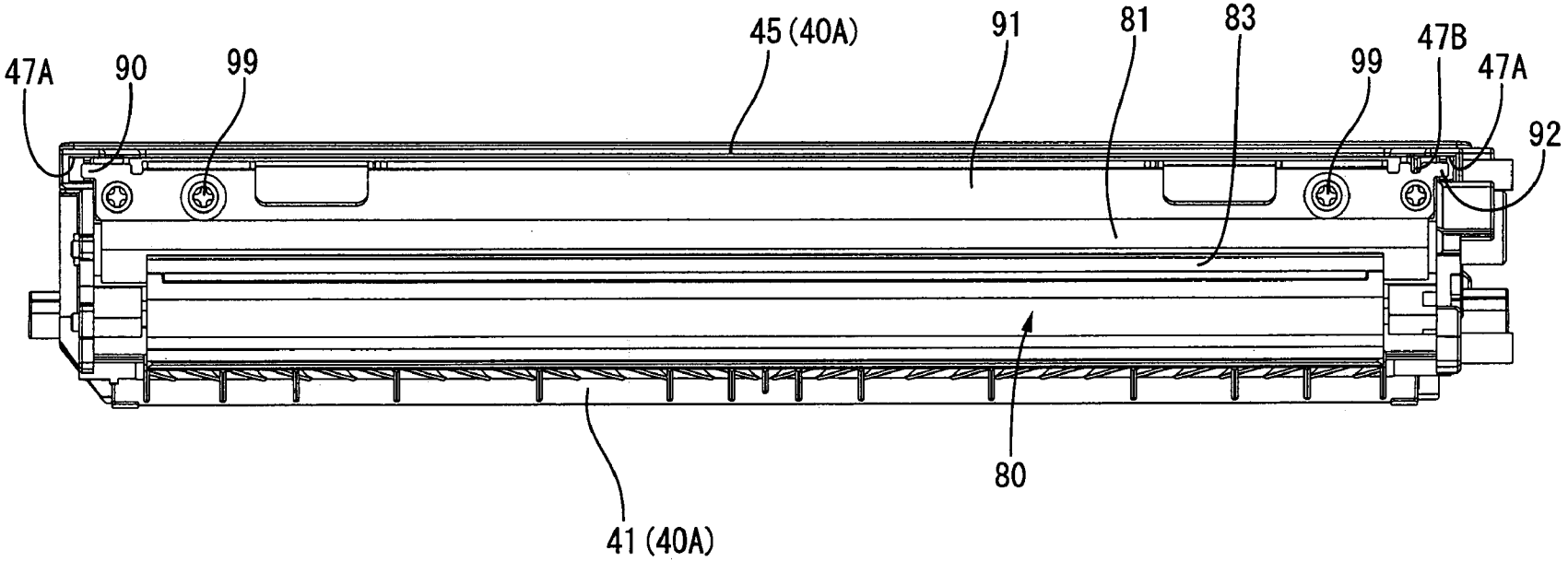
FIG. 5 is a rear view of the developing cartridge.
Figure 6:
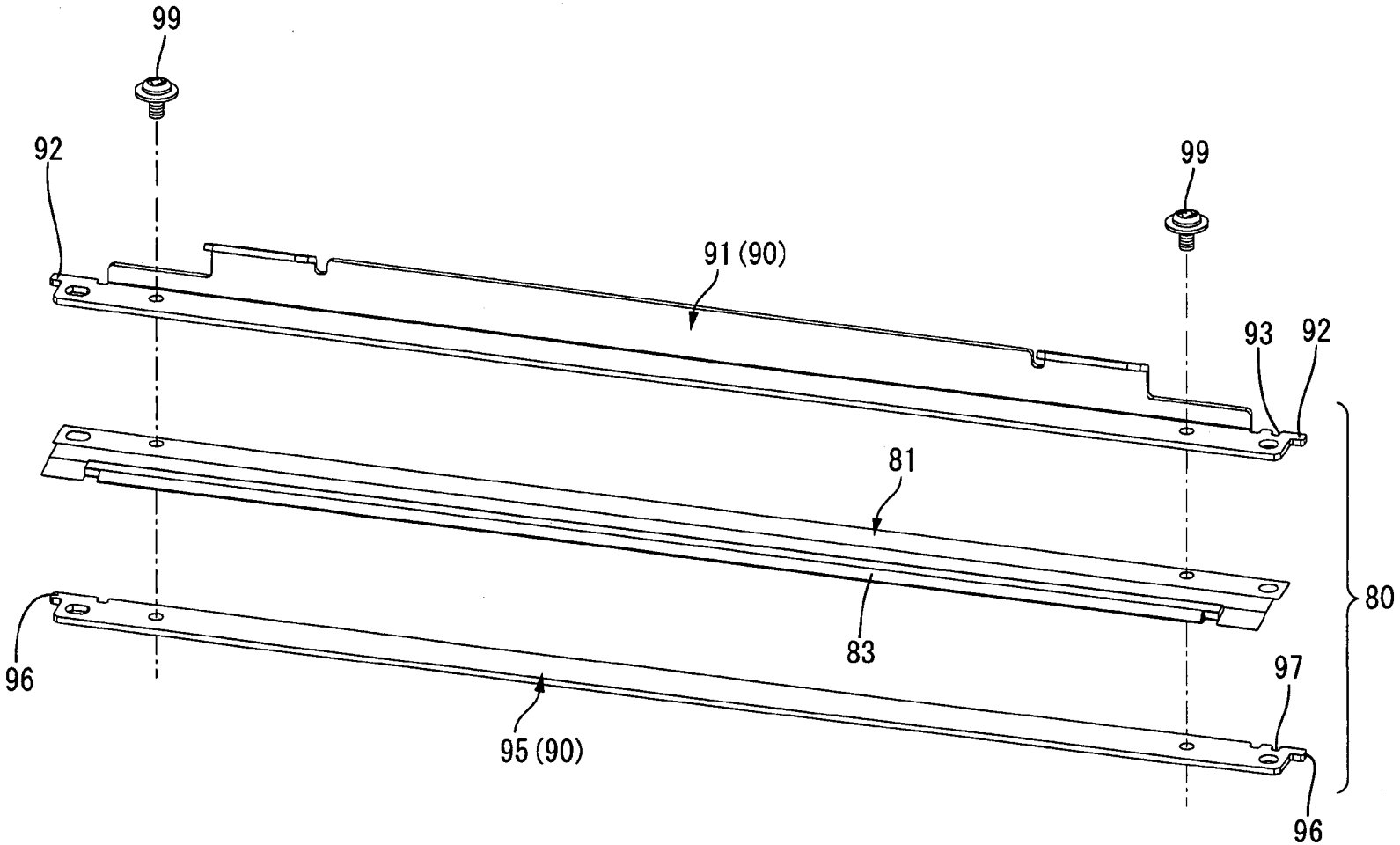
FIG. 6 is a disassembled perspective view of a layer thickness restricting blade.
Figure 7:
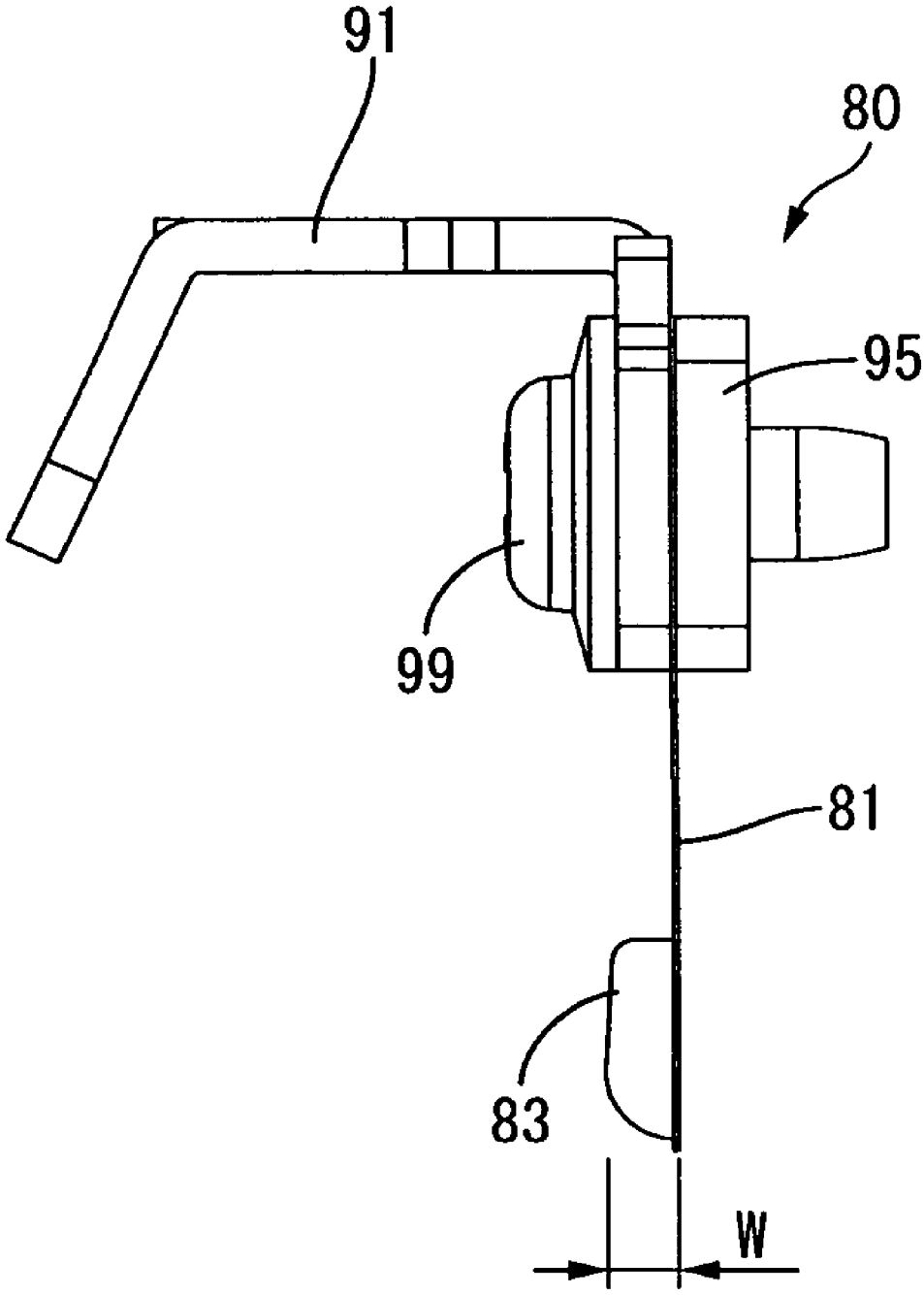
FIG. 7 is a sectional view of the layer thickness restricting blade.
Figure 8:
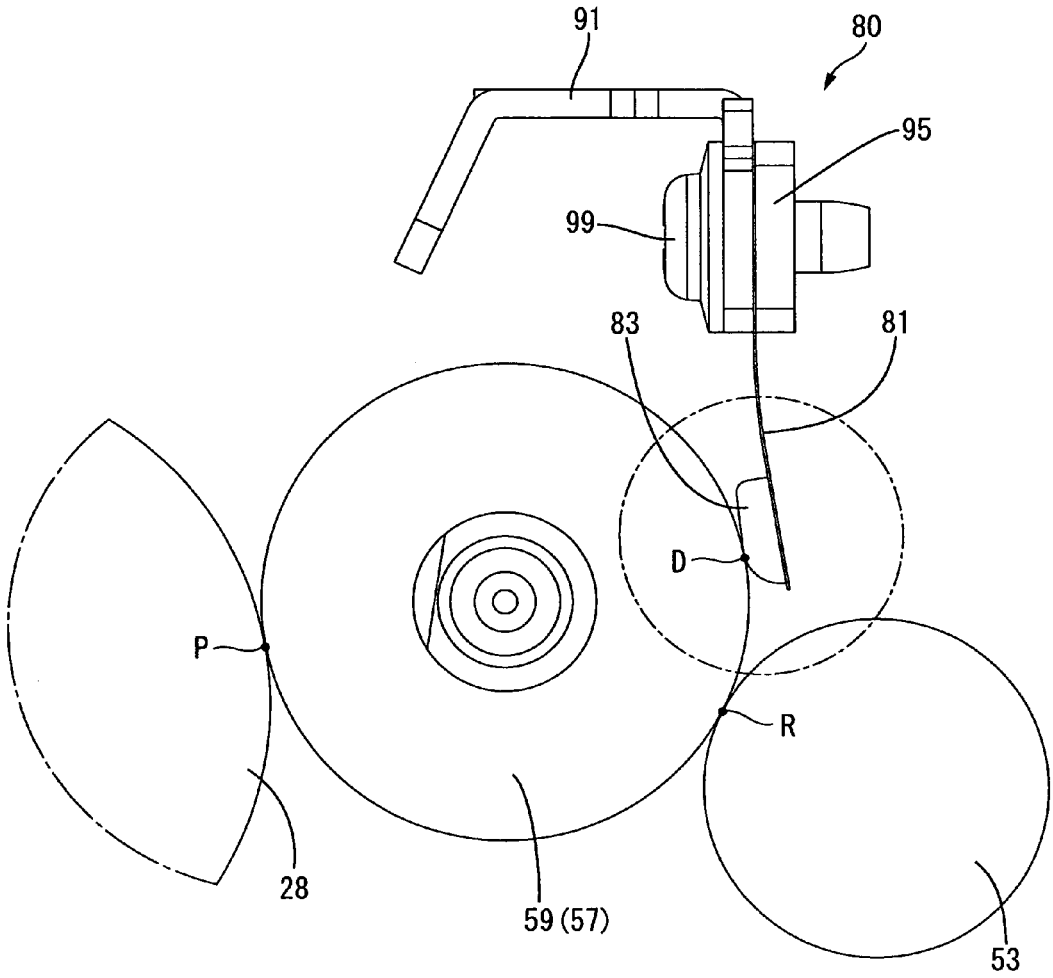
FIG. 8 is a view showing a state of bending an arm main body.

FIG. 4 is a perspective view viewing the developing cartridge from a rear side, FIG. 5 is a rear view of the developing cartridge and FIG. 6 is a disassembled perspective view of the layer thickness restricting blade. FIG. 7 is a side view of the layer thickness restricting blade, and FIG. 8 is a view showing a state of bringing the layer thickness restricting blade into contact with the developing roller. Further, although the developing roller 57 is a part mounted to the developing cartridge 40, since the layer thickness restricting blade 80 is concealed, FIG. 5 shows a state of removing the developing roller 57.

As shown by FIG. 4, the layer thickness restricting blade (in correspondence with a layer thickness restricting member of the invention) 80 is arranged at a rear portion (on this side of the drawing) of the upper frame 45 and at a position upward from the developing roller 57. Explaining further specifically, the layer thickness restricting blade 80 is configured by an arm main body (in correspondence with an arm member of the invention) 81 comprising spring steel in a shape of a thin flat plate extended horizontally along the roller shaft 58 of the developing roller 57 and provided with a contact portion 83, mentioned later, at a front end thereof, and a reinforcing plate 90 for forcing an attitude thereof such that the arm main body 81 is not brought into a state of being bent in a bow-like shape (refer to FIG. 6).

The reinforcing plate 90 is configured by a main plate 91 having a section in an L-like shape and a sub plate 95 constituted by a flat plate shape. Both of the plates 91, 95 are made of a metal and constituted by a shape prolonged in a transverse direction along the roller shaft 58 of the developing roller 57 similar to the arm main body 81 and the both plates 91, 95 are fixed between faces thereof opposed to each other by a setscrew 99 in a state of pinching an upper portion of the arm main body 81. Further, the main plate 91 is configured by the L-like shape for increasing a rigidity thereof.

As shown by FIG. 3, FIG. 5, two upper portions of two left and right ends of the layer thickness restricting blade 80 are fixed to an L-like bracket 98 on a section L-like side fixed to the upper frame 45 by screws. Thereby, an upper portion of the arm main body 81 of the layer thickness restricting blade 81 pinched by the two plates 91, 95 constitutes a fixed end and a lower portion side (a portion pasted with a contact portion 83, mentioned later) thereof is bendable in a front and rear direction (X axis direction) of the laser printer 1.

Further, as shown by FIGS. 5 and 6, both end portions of the plates 91, 95 are formed with projected pieces 92, 96 respectively projected outwardly, further, right end portions thereof are formed with recess portions 93, 97, these are used for positioning in fixing the layer thickness restricting blade 80 to the cabinet 40A, positions of the cabinet 40A opposed to the projected pieces 92, 96 are formed with receiving portions 47A fitted to the projected pieces 92, 96 by recesses and projections thereof, and positions thereof opposed to the recess portions 93, 97 are formed with projected pieces 47B fitted to the recess portions 93, 97 by recesses and projections thereof.

The contact portion includes a rubber member made of silicone and a width dimension thereof is set to be more or less narrower than a width of the roller main body 59 of the developing roller 57. The contact portion 83 is pasted to a face of the arm main body 81 on a side of being opposed to the developing roller 57 by, for example, an adhering agent. The contact portion 83 is configured by the same sectional shape over a total width thereof except both ends in a width direction and is formed by, for example, injection molding. As shown by FIG. 7, the sectional shape of the contact portion 83 is configured by substantially a rectangular shape prolonged in an up and down direction and a thickness dimension (W dimension shown in the drawing) is configured by a thickness dimension such that a surface of the contact portion 83 interferes with a surface of the developing roller 57.

Thereby, when the layer thickness restricting blade 80 is brought into a state of a single member, the arm main body 81 is brought into a state of being hung straightly downward, however, when set to the cabinet 40A, as shown by FIG. 8, the arm main body 81 is elastically bent to a right side of the drawing by being pressed by the developing roller 57. In this way, the contact portion 83 of the layer thickness restricting blade 80 is brought into elastic contact with the roller main body 59 over a total width of the roller main body 59 on a path of carrying the toner T (between a contact point R at which the toner supply roller 53 and the developing roller 57 are brought into contact with each other and a point P at which the developing roller 57 and the photosensitive drum 28 are brought into contact with each other).

Further, a corner portion (corner portion on a lower side) of a section of the contact portion 83 is formed in a gradually bent shape, further specifically, in an arc shape continuous to a contact point D in contact with the roller main body 59, and a gap between the corner portion and the roller main body 59 is widely constituted. By constituting in this way, the toner T is made to be easy to advance between the contact portion 83 and the developing roller 57.

The toner T adhered to the developing roller 57 passes through the contact portion 83 of the layer thickness restricting blade 80 in accordance with progress of rotation of the developing roller 57, at this occasion, the toner T is moved while slightly bending the arm main body 81 of the layer thickness restricting blade 80 to the right direction of FIG. 8 and therefore, the toner T receives a constant repulsive force from the contact portion 83. Thereby, the toner T is restricted such that a layer thickness is made to be constant (in correspondence with a regular layer thickness of the invention), further, in passing the contact portion 83, the toner T is positively charged by friction by being strongly rubbed to a surface of the contact portion 83, or the surface of the developing roller 57. Further, the toner T the layer thickness of which is restricted to be constant and which is charged by friction is delivered to the photosensitive drum 28, explained below, by rotating the developing roller 57.

Further, the layer thickness of the toner T adhered onto the developing roller 57 is made to be constant as described above for making a darkness of an image formed on the sheet 3 a desired darkness. That is, the darkness of the image is related to the layer thickness of the toner T, when the layer thickness is thick, the image becomes dark and when the layer thickness is thin, the image becomes thin. This is because the thicker the layer thickness, the larger the amount of the toner T adhered to an exposed portion on the photosensitive drum 28 in developing explained below.

As shown by FIG. 2, the photosensitive drum 28 is configured by a cylindrical shape and is provided with a drum main body 32 the topmost layer of which is formed by a positively charging photosensitive layer comprising polycarbonate or the like, and a drum shaft 33 made of a metal as a shaft extended along a longitudinal direction of the drum main body 32 at an axis center of the drum main body 32. The drum shaft 33 is supported by side plates in a rotatable state.

The scorotron type charger 29 is arranged to be opposed to the photosensitive drum 28 to be spaced apart therefrom by a predetermined interval so as not to be brought into contact with the photosensitive drum 28. The scorotron type charger 29 is the scorotron type charger for charging positively generating corona discharge from a charging wire 29A of tungsten or the like and functions to uniformly positively charge a surface of the photosensitive drum 28.

The transcribing roller 30 is rotatably supported by side plates, opposed to be brought into contact with the photosensitive drum 28 in an up and down direction and is arranged to form a nip between the transcribing roller 30 and the photosensitive drum 28. The transcribing roller 30 is configured by covering a roller shaft 34 made of a metal by a roller 35 comprising a conductive rubber material. The cleaning brush 31 is arranged on a rear side of the photosensitive drum 28 in a state in which a front end of the brush is brought into contact with a surface of the drum main body 32 of the photosensitive drum 28.

From the above-described, a potential of the surface of the photosensitive drum 28 is brought into a high voltage state of, for example, about 870 V by being uniformly and positively charged by the charger 29. Further, from the state, a laser beam is scanned at high speed from the scanner portion 17 explained above to a surface of the photosensitive drum 28. Thereby, at a scanned portion, positive charge is reduced (exposed) and therefore, a potential of the exposed portion is going to a state of being reduced to, for example, about 100 V. Thereby, an electrostatic latent image is formed on the photosensitive drum 28.

Figure 9:
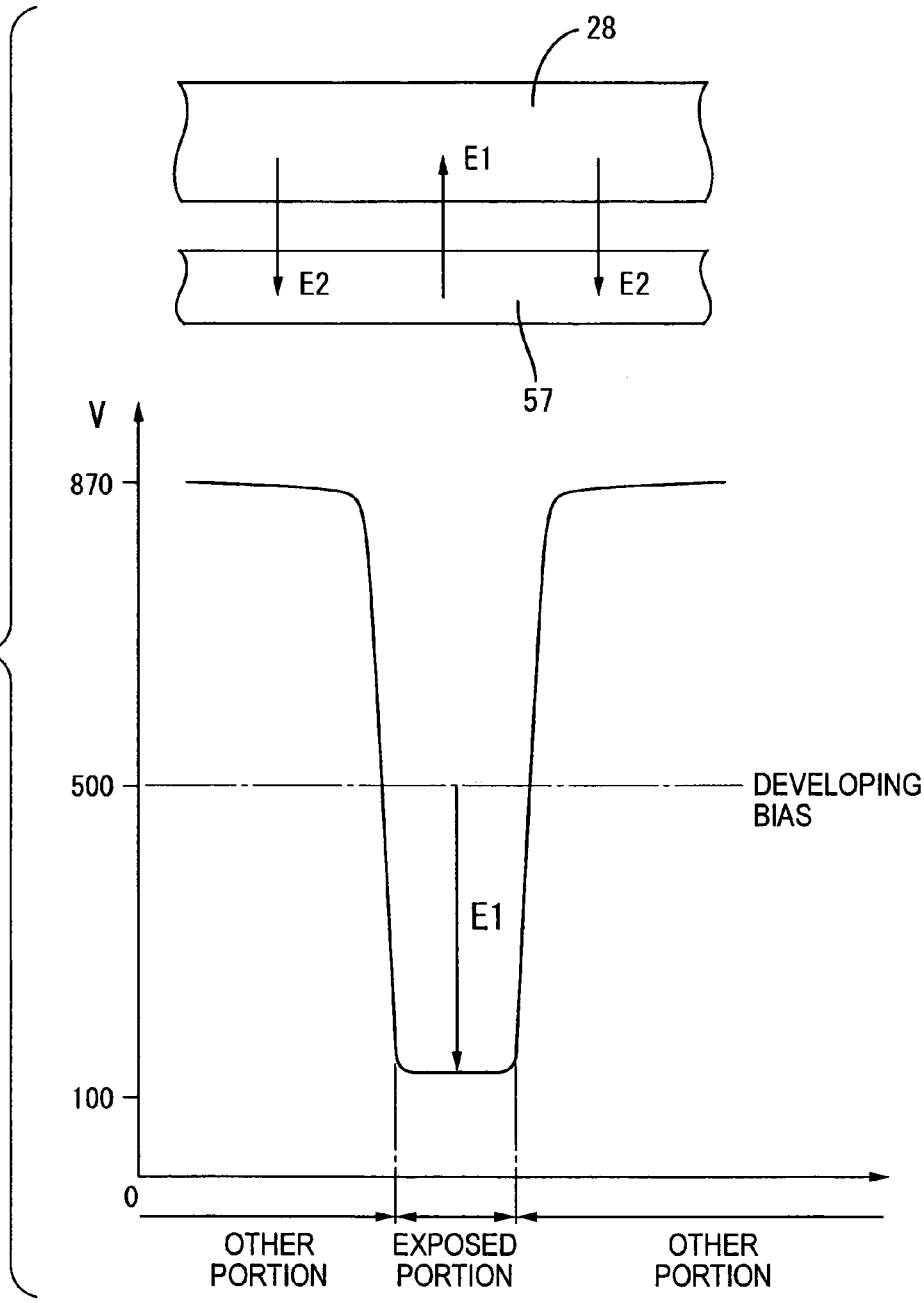
FIG. 9 is a view showing a relationship between a developing bias and exposure.

On the other hand, the roller shaft 58 of the developing roller 57 is applied with a developing bias voltage of, for example, about 500 V. Thereby, as shown by FIG. 9, at the exposed portion, an electric field E1 directed from the developing roller 57 to the photosensitive drum 28 is generated and in contrast thereto, at a portion which is not exposed, an electric field E2 (electric field in which a direction of the electric field is inverse to E1) directed from the photosensitive drum 28 to the developing roller 57 is generated.

Thereby, at the exposed portion, the toner T which is charged positively is attracted to a side of the photosensitive drum 28 by being operated by the electric field E1 and therefore, the toner T on the developing roller 57 is adhered to a surface of the drum when the toner T is opposed to be brought into contact with the photosensitive drum 28. Thereby, the electrostatic latent image is visualized and the toner image is formed on the photosensitive drum 28. Further, the toner image is transcribed onto the sheet 3 when the sheet 3 passes through the transcribing position S.

In contrast thereto, at the portion which is not exposed, the electric field E2 is generated to hamper the toner T from moving to the side of the photosensitive drum 28 and therefore, even when the toner T is brought into contact with the surface of the drum, the toner T is not adhered onto the photosensitive drum 28.

In this way, only a portion of the toner T adhered to the developing roller 57 is developed and adhered to the photosensitive drum 28 and a remaining most portion thereof is not adhered to the photosensitive drum but rotated by substantially one rotation at an outer periphery of the developing roller 57 to reach an inlet of the returning path 43A explained above. Thereafter, the toner T returns to the toner storage chamber 48A by passing the returning path 43A and is agitated with the remaining toner at inside of the toner storage chamber 48A by the agitator 50. That is, the toner T repeats the cycle of friction charge->adhering to developing roller->returning to toner storage chamber->friction charging.

As shown by FIG. 1, the fixing portion 61 is provided on a rear side of the process cartridge 25 and is provided with a fixing frame 67, and a heating roller 68 and a pressing roller 69 at inside of the fixing frame 67.

The heating roller 68 is provided with a metal tube a surface of which is coated by fluororesin and a halogen lamp for heating at inside of the metal tube, and is driven to rotate by inputting power from a motor, not illustrated. On the other hand, the pressing roller 69 is arranged to be opposed to press the heating roller 68 on a lower side of the heating roller 68. The pressing roller 69 is configured by covering a roller shaft made of a metal by a roller comprising a rubber material and is driven by driving to rotate the heating roller 68.

At the fixing portion 61, the toner T transcribed onto the sheet 3 at the transcribing position S is thermally fixed during a time period of passing the sheet 3 between the heating roller 68 and the pressing roller 69. The sheet 3 fixed with the toner T is carried to a sheet discharge path 70 extended in an up and down direction to an upper face of the main body casing 2. The sheet 3 carried to the sheet discharge path 70 is folded back in a U turn shape to the front side of the laser printer 1 by a sheet discharge roller 71 provided on an upper side thereof and is discharged onto a sheet discharge tray 72 formed on the upper face of the main body casing 2.

Now, as described above, the toner T repeats a cycle of friction charging->adhering to developing roller->returning to toner storage chamber->friction charging and therefore, at each time of developing, the toner T rubs the developing roller 57 or the contact portion 83 and therefore, the toner T is gradually deteriorated and is difficult to be charged by friction and when the deterioration is left as it is, the image quality is deteriorated. Hence, the layer thickness restricting blade 80 is provided with a mechanism by which when a timing of interchanging the toner T is reached, the timing is informed to an operator.

Figure 10:
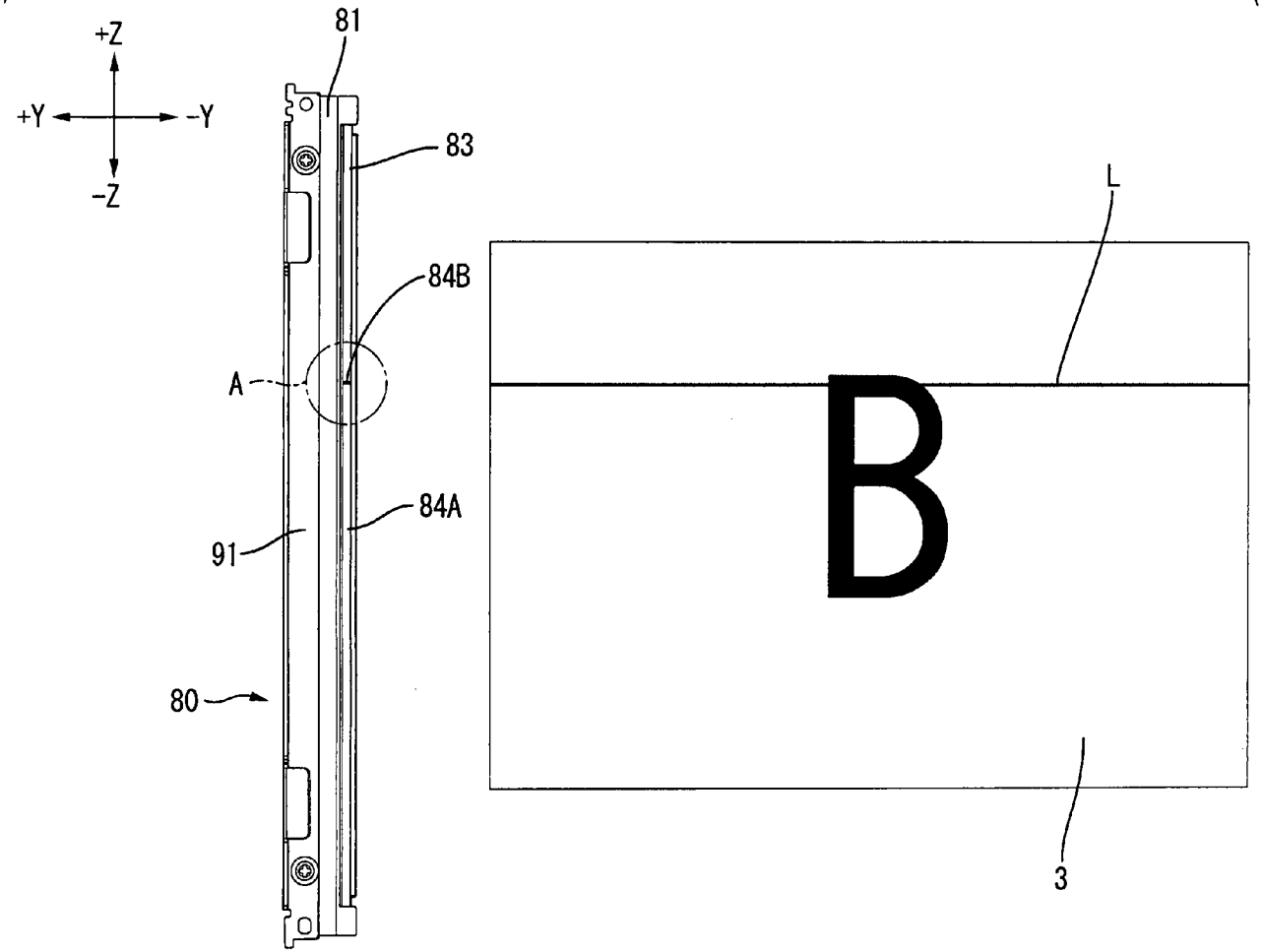
FIG. 10 is a conceptual view showing a failure in an image.
Figure 11:
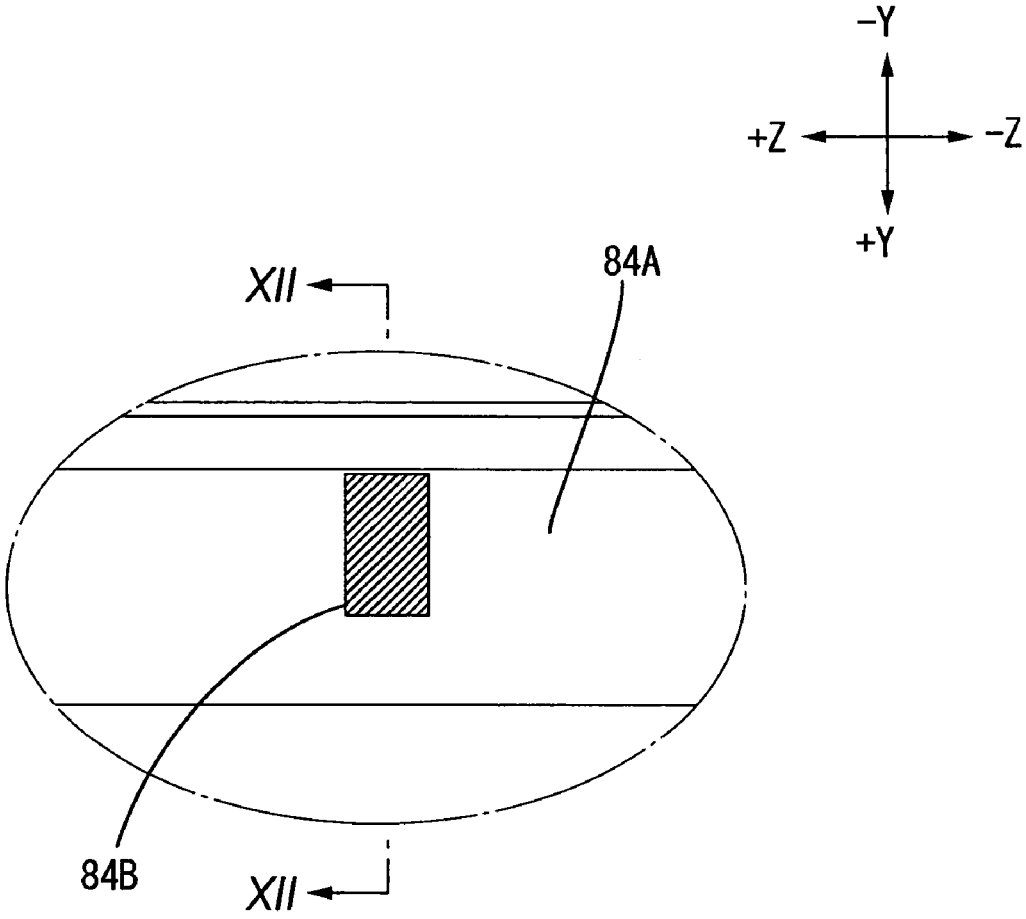
FIG. 11 is a plane view enlarging portion A shown in FIG. 10.
Figure 12A:
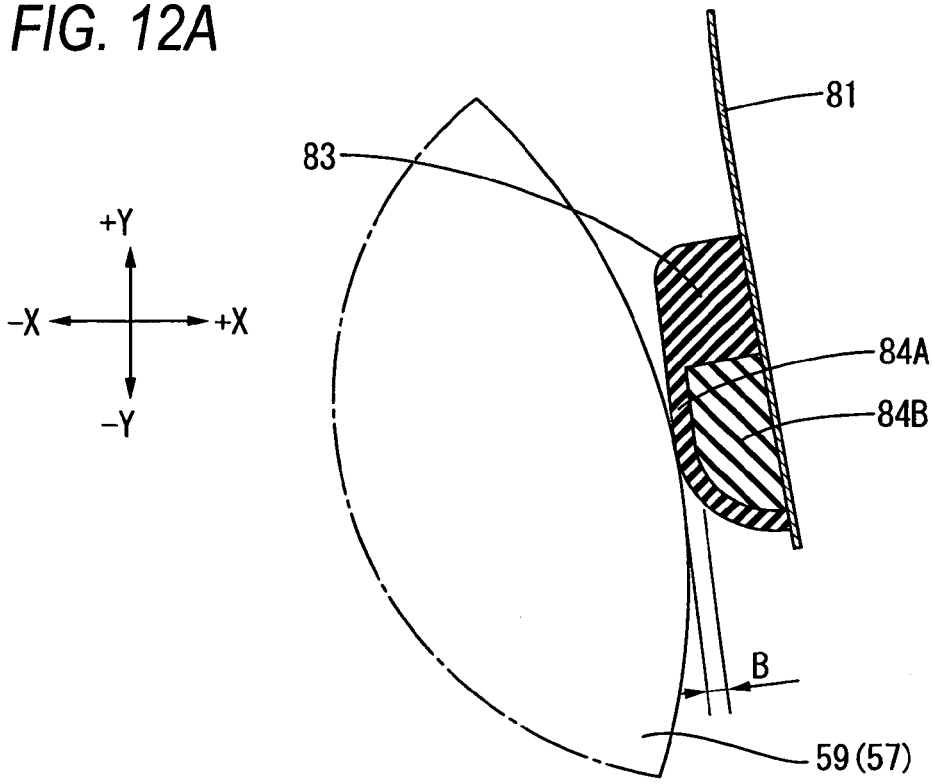
FIGS. 12A and 12B are sectional views taken along a line XII-XII of FIG. 11.
Figure 12B:
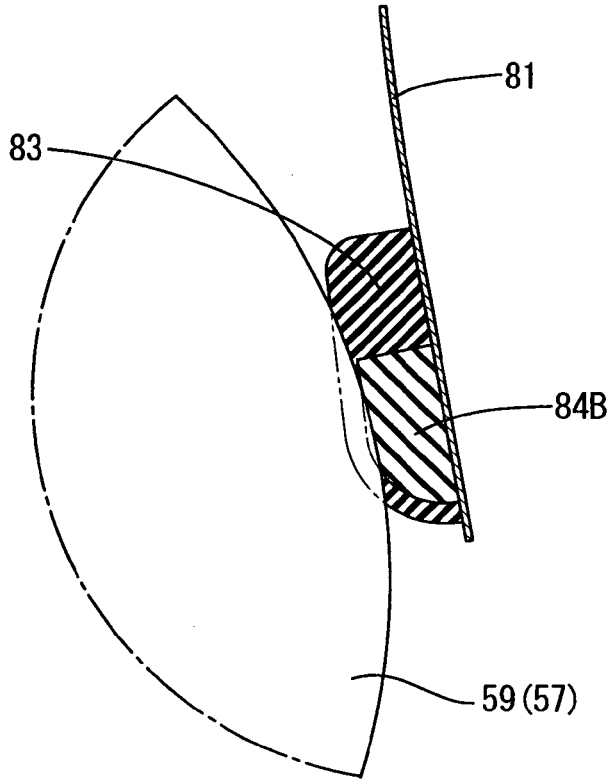

FIG. 10 is conceptual view showing a behavior of forming an image in a state of exposing a polyurethane layer, FIG. 11 is a plane view enlarging portion A of FIG. 10, and FIGS. 12A and 12B illustrate sectional views taken along a line XII-XII of FIG. 11 (sectional view when viewed from +Z direction).

A region of a portion of the contact portion 83 proximate to a center in a width direction (Z direction) (region indicated by a hatching of FIG. 10) is inserted with a rubber member made of polyurethane (hereinafter, referred to as polyurethane layer) As shown by FIGS. 12A and 12B, the polyurethane layer (in correspondence with a second layer of the invention) is inserted to a lower region of the contact portion 83 opposed to the developing roller 57, and a surface side thereof is brought into a state of being covered by a rubber member made of silicone (having a material the same as that of other region and in correspondence with a first layer of the invention).

The polyurethane layer 84B is inserted in this way for bringing about a failure in an image formed on the sheet 3 by exposing the polyurethane layer 84B on the surface side when the developing roller 57 reaches a predetermined rectified revolution number (revolution number in correspondence with a timing of interchanging the toner T).

That is, as described above, the surface of the contact portion 83 is brought into a state of being brought into elastic contact with the surface of the developing roller 57 and strongly rubs the developing roller 57 in accordance with rotation thereof. Further, since the developing roller 57 and the contact portion 83 comprise the same rubber member made of silicone, at each time of rubbing the developing roller 57 and the contact portion 83, the silicone layer 84A of the contact portion 83 is gradually worn.

An amount of wearing (amount of scraping) of the silicone layer 84A is substantially proportional to the revolution number of the developing roller 57 and therefore, by determining a thickness of the polyurethane layer 84B based on the amount of wearing (amount of scraping) the silicone layer 84A and the rectified revolution number of the developing roller 57, when rotation of the developing roller 57 reaches the rectified revolution number, as shown by FIG. 12B, the polyurethane layer 84B is exposed to the surface side to be brought into a state of being in contact with the developing roller 57.

Here, polyurethane is a material in which an arrangement of a charging row thereof is more proximate to acryl which is a main material of the toner T than silicone and which is difficult to generate friction charging with respect to acryl. Therefore, once the polyurethane 84B is exposed to the surface, at the portion, even when the toner T rubs the polyurethane 84B, the amount of charging the toner T becomes smaller than that in the state before exposure.

Although the toner T is brought into contact with the surface of the photosensitive drum 28 finally, the charge amount is not sufficient and therefore, the forces exerted from the electric fields E1, E2 are significantly reduced by that amount. Therefore, at the portion of the region at which the polyurethane layer 84B is exposed, despite the electrostatic latent image, the toner is adhered to the surface of the photosensitive drum 28 (failure in development). Therefore, as shown by FIG. 10, at the portion, whereas an image of a line L a width of which is equal to a width of the polyurethane layer 84B and which is straight along a direction of feeding the sheet 3 is formed on the sheet, at other portion, an image in accordance with the electrostatic latent image (image of character B in the illustrative aspect) is formed.

In this way, according to the illustrative aspect, when a revolution number of the developing roller 57 reaches the predetermined rectified number of times and the polyurethane layer 84B is exposed, the above-described failure of the electrostatic latent image (line L is drawn on the sheet 3) is brought about and therefore, the operator can be informed that a timing of interchanging the toner T is reached by bringing about a failure in development (failure in image). Thereby, the operator interchanges the developing cartridge 40 and therefore, it is avoided to continue using the deteriorated toner T and an excellent image quality is maintained always. Further, the mechanism of informing the operator that a timing of interchanging the toner T is reached is realized without an increase in a number of parts and therefore, the structure is not complicated and the cost is not increased.

Further, the deterioration of the toner T is progressed proportionally to a number of times of development (revolution number of developing roller) and therefore, in principle, polyurethane may be inserted to either of the contact portion 83 of the layer thickness restricting blade 80 or the developing roller 57, according to the illustrative aspect, polyurethane is rather inserted to a side of the contact portion 83. This is in consideration of a property of adhering the toner T to the developing roller 57.

That is, according to the illustrative aspect, a nonmagnetic toner is used for the toner T and the toner T is carried by being carried on a surface of the roller by a friction force between the toner T and the surface of the developing roller 57. That is, although the surface of the developing roller 57 needs to be constituted by rough face to generate a pertinent friction force between the surface and the toner T, when there is assumedly constructed a configuration of positively wearing the side of the developing roller 57, a failure in carrying the toner T is brought about.

Further, although there is a magnetic type toner in the toner T other than the nonmagnetic type, the toner T using the magnetic toner needs to provide a magnet for adsorbing the magnetic toner at an inner peripheral portion of the developing roller 57 and the structure is complicated, according to the illustrative aspect, the magnet for adsorbing the toner is not needed and therefore, the structure can be simplified by that amount.

Second Illustrative Aspect

A second illustrative aspect of the invention will be explained in reference to FIG. 13 through FIG. 15D.

Figure 13:
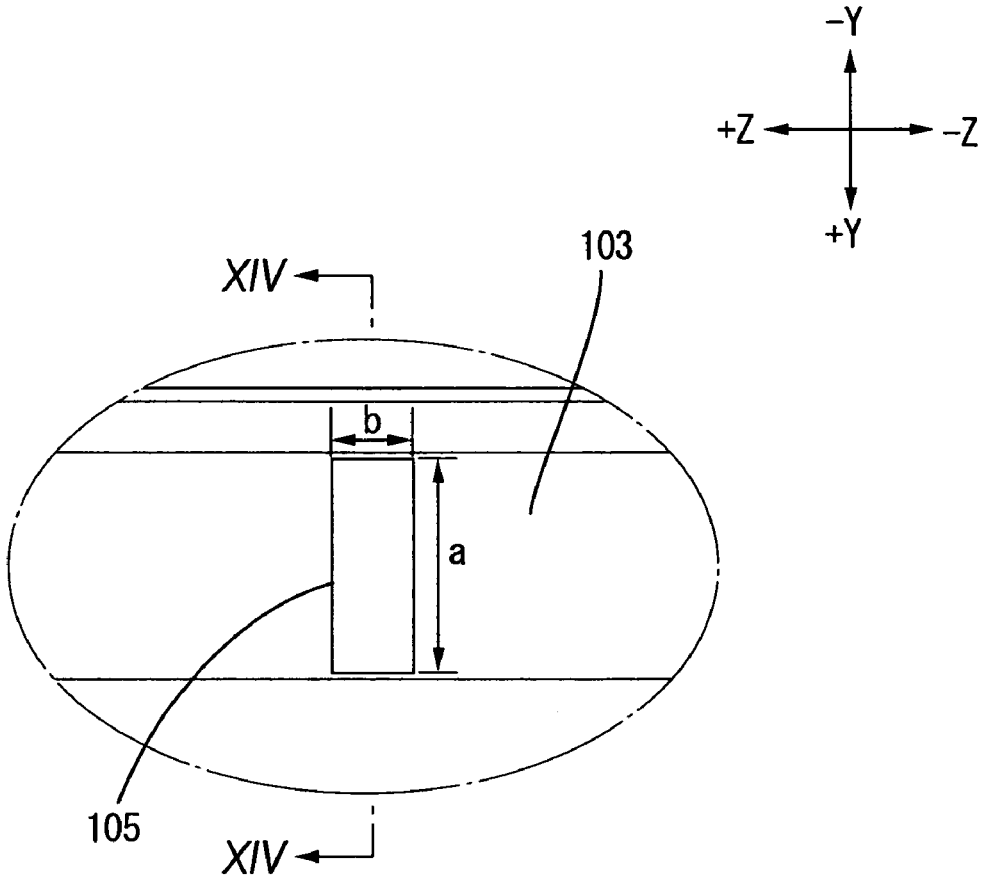
FIG. 13 is a view viewing a hollow portion from X axis direction according to a second illustrative aspect.
Figure 14A:
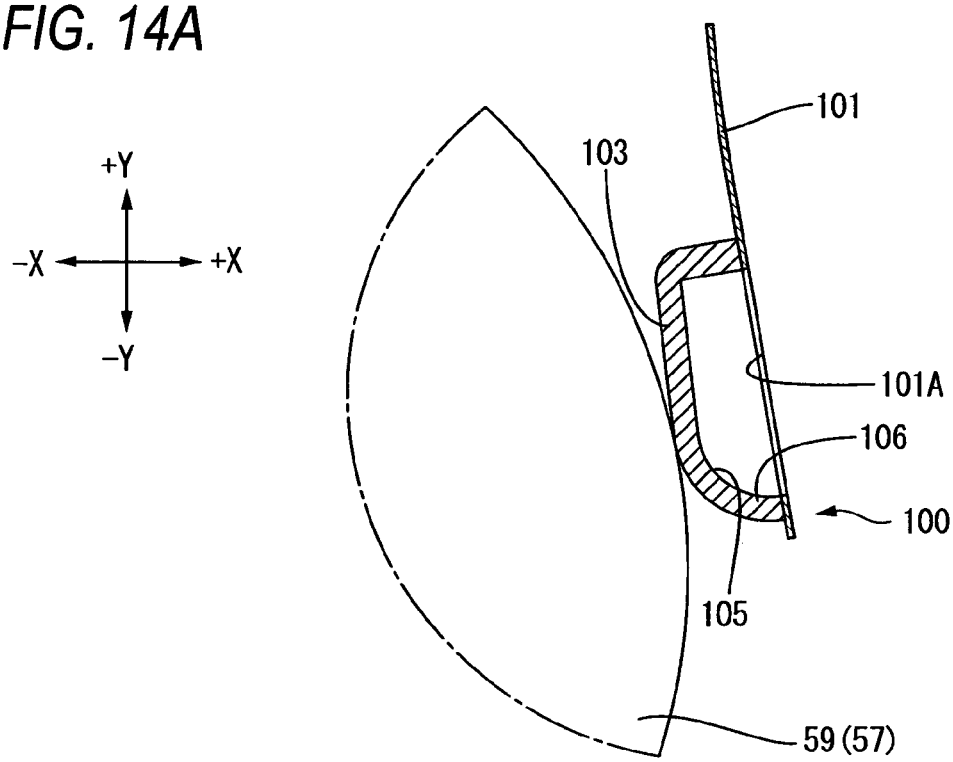
FIGS. 14A and 14B are views taken along a line XIV-XIV of FIG. 13.
Figure 14B:
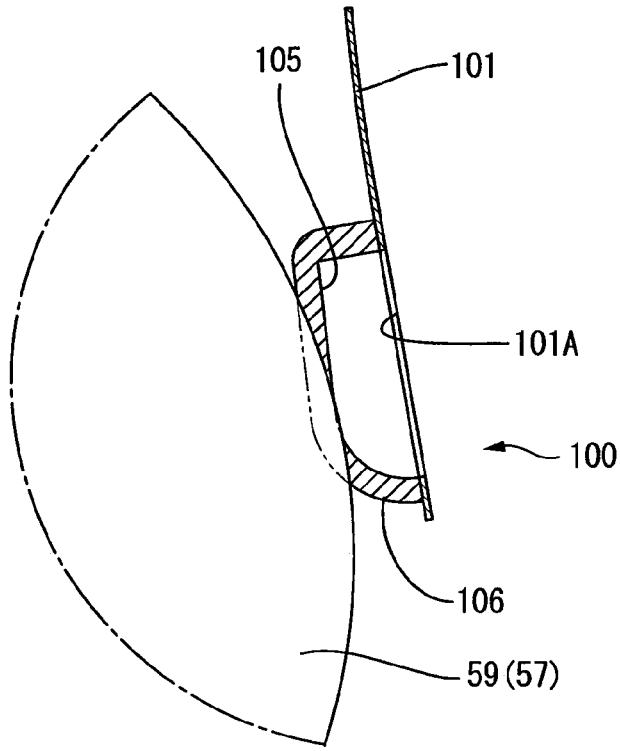

FIG. 13 is a view viewing a hollow portion from X axis direction (in correspondence with a view enlarging portion A of FIG. 10), FIGS. 14A and 14B are sectional views taken along a line XIV-XIV (sectional view when viewed from +Z direction) of FIG. 13, and FIGS. 15A-15D are views schematically showing a step of molding a layer thickness restricting portion blade.

Although in the first illustrative aspect, a failure in the image is brought about by utilizing that the development is not correctly carried out unless the toner T is correctly charged, according to the second illustrative aspect, a failure in the image is brought about by utilizing that when a layer thickness of the toner T adhered onto the surface of the developing roller 57 is changed, a darkness of the image is changed in accordance therewith. Explaining specifically, as shown by FIG. 13, the second illustrative aspect is provided with a hollow portion 105 in place of the polyurethane layer 84B of the first illustrative aspect at the same position.

In the second illustrative aspect, the hollow portion 105 serves as a releasing layer that releases the layer thickness from being restricted.

The hollow portion 105 is configured by a recess shape opened to a side of an arm main body 101 (refer to FIG. 10) and a sectional shape thereof in a horizontal direction is configured by a rectangular shape a dimension (dimension a) in Y axis direction of which is long and a dimension (dimension b) in Z axis direction of which is short (refer to FIG. 13).

Further, when the revolution number of the developing roller 57 reaches the rectified number of times, similar to the case of the first illustrative aspect, the silicone layer 84A on the surface side is scraped by wear and the hollow portion 105 is exposed to the surface side. Thereby, a hollow gap is formed between the hollow portion 105 and the developing roller 57 (refer to FIG. 14B). At the portion of forming the hollow gap, a repulsive force of the layer thickness restricting blade 100 becomes weaker than that of other portion. Therefore, the toner T is made to be easy to pass the layer thickness restricting blade 100 and therefore, a layer thickness of the toner T becomes thicker than that of other portion. Thereby, the darkness of the image formed on the sheet 3 becomes dark only at the portion in correspondence with the hollow gap in comparison with other portion.

In addition thereto, when the hollow gap is formed between the hollow portion and the developing roller 57, also the effect of first illustrative aspect (failure of development of electrostatic latent image) can be expected. This is because at the hollow gap portion, the toner T passes the contact portion 83 without hardly rubbing the contact portion 83.

Further, when the hollow portion 105 is provided, the rigidity thereof becomes weaker than that of other portion and therefore, even at a stage before the revolution number of the developing roller 57 reaches the rectified number of times, there is a concern of thickening the layer thickness of the toner T only at the portion, however, according to the illustrative aspect, the sectional shape of the hollow portion 105 is configured by a rectangular shape the dimension (dimension a) in Y axis direction of which is long and the dimension (dimension b) in Z axis direction of which is short as described above. In other words, the sectional shape is configured by a shape which is long in a direction of rotating the developing roller 57 and short in a direction of the roller shaft of the developing roller 57. When constituted by such a shape, a reduction in the rigidity can be minimized and therefore, at the stage before the developing roller 57 reaches the rectified revolution number, the layer thickness is not varied and an excellent image quality is maintained.

Further, a wall portion (in correspondence with a restricting portion of the invention) 106 restricts the toner T from flowing out such that the toner T does not flow out to the side of the photosensitive drum 28 by passing the hollow portion 105.

When the wall portion 106 is not assumedly provided and the silicone layer 84A of the surface is worn, the toner T is permitted to flow out freely to a side of the photosensitive drum 28 by passing the hollow portion 105, the flow out amount of the toner T becomes excessively large. In that case, a large amount of the toner is adhered to the sheet 3 after forming the image and an unpleasant feeling is obliged to be given to the operator, however, when the toner T is restricted from flowing out as mentioned above, such a problem can be avoided from being brought about beforehand.

Next, a step of molding the layer thickness restricting blade 100 will be explained in reference to FIGS. 15A-15D. Numeral 110 indicated in the drawing designates an upper die and numeral 120 designates a lower die. The lower die 120 is further constituted by a lower die main body 121 for supporting the arm main body 101 and a hollow forming die 125 for forming the hollow portion 105. The hollow forming die 125 is configured by a curved shape bulged to an upper side of the drawing by penetrating a through hole 121A provided at a center portion of the lower die main body 121 in an up and down direction.

Further, according to the second illustrative aspect, a portion of the arm main body 101 opposed to the hollow forming die 125 is formed with a through hole (in correspondence with a hole of the invention) 101A for inserting a bulged portion of the hollow forming die 125.

Figure 15A:
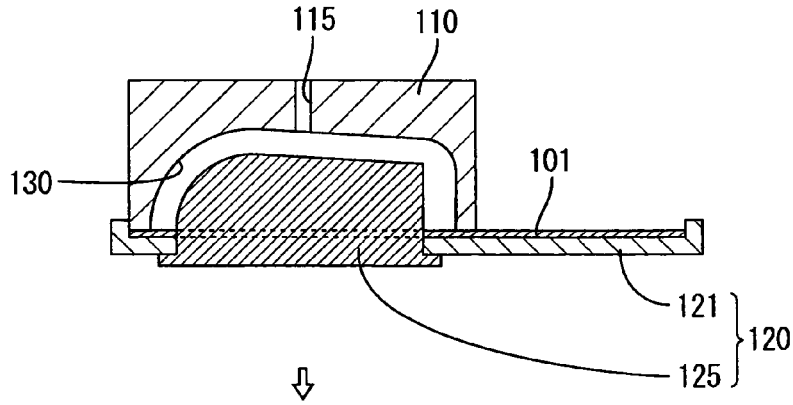
FIGS. 15A-15D illustrate views showing a step of molding a layer thickness restricting portion blade.
Figure 15B:
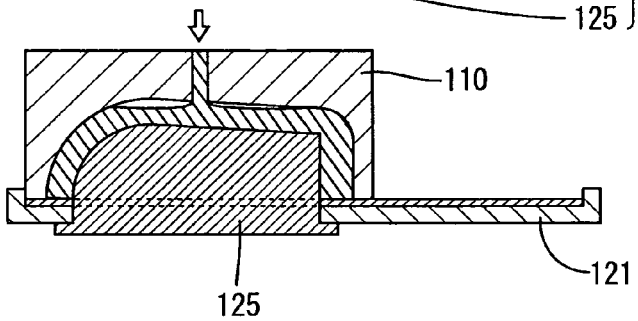
Figure 15C:
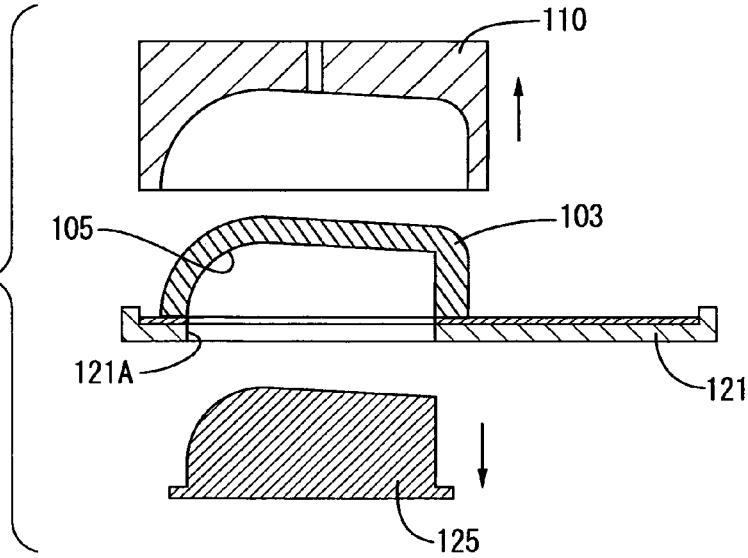
Figure 15D:
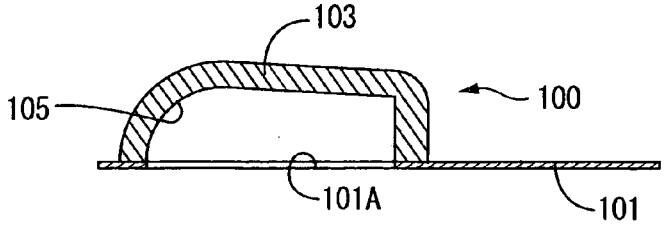

As shown by FIG. 15A, when the arm main body 101 is set to an upper face of the lower die 120 and the dies are closed, a cavity 130 is formed between the two dies 110, 120. Further, as shown by FIG. 15B, a melted resin (silicone member) is made to flow into the cavity 130 from an injection hole 115 formed at the upper die and thereafter, cooled. When the injected melted resin is solidified, at this occasion, as shown by FIG. 15C, when the dies are opened, as shown by FIG. 15D, after forming the hollow portion 105 at a contact portion 103, the contact portion 103 can be molded integrally with the arm main body 101 (so called outsert molding).

Third Illustrative Aspect

A third illustrative aspect of the invention will be explained in reference to FIGS. 16A and 16B (vertical sectional view of a layer thickness restricting blade). Although according to second illustrative aspect, when the revolution number of the developing roller 57 reaches the rectified number of times, a portion of the image is displayed to be dark, according to the third illustrative aspect, a portion of the image is thinned in contrast to the second illustrative aspect.

Figure 16A:
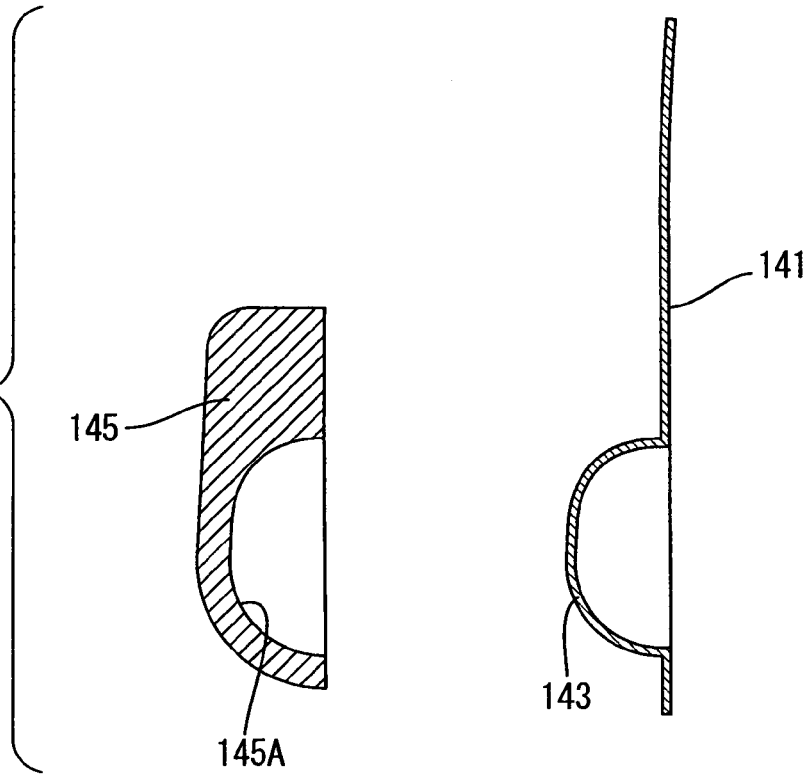
FIGS. 16A 16B are sectional views of a front end portion of layer thickness restricting blade according to a third illustrative aspect.
Figure 16B:
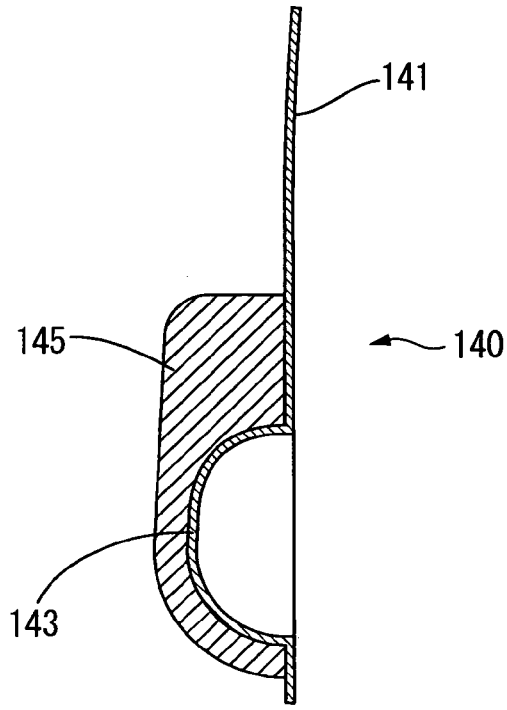

As shown by FIGS. 16A and 16B, whereas a contact portion 145 is formed with a recess portion 145A opened to a side of an arm main body 141, a projected portion 143 is formed at a position of an arm main body 141 opposed to the recess portion 145A. Further, when the contact portion 145 is fixedly attached to the arm main body 141, the projected portion 143 of the arm main body 141 is fitted to the recess portion 145A without a gap therebetween.

Also in the third illustrative aspect, when the rotation of the developing roller 57 reaches the rectified revolution number, by wearing and scraping the silicone layer 84B of the surface, the projected portion 143 is exposed to the surface side and is brought into contact with the developing roller 57. At the portion of exposing the projected portion 143, the toner T becomes difficult to pass therethrough and therefore, the layer thickness of the toner T becomes thin, as a result, the image is thinned at the portion.

In addition thereto, a metal (arm main body 141) is more difficult to be charged by friction than silicone and therefore, also a failure in charging is brought about at the portion. Thereby, according to third illustrative aspect, when the developing roller 57 reaches the rectified revolution number, in addition to thinning the image, also a failure in developing the electrostatic latent image is brought about similar to first illustrative aspect. By bringing about a failure in the dark and thin image and a failure in developing the electrostatic latent image compoundedly, the operator can firmly be informed that the timing of interchanging the toner T is reached.

Other Illustrative Aspect

The present invention is not limited to the illustrative aspects explained by the above-described description and the drawings but, for example, the following illustrative aspects are also included in the technical range of the invention and the invention can be embodied by variously changing the invention within the range not deviated from the gist other than described below.

(1) Although according to the first illustrative aspect, the contact portion is configured by two materials having different charging properties (charging row with respect to acryl poses a problem), when the toner T passes a contact portion, a failure in charging may be brought about, for example, the contact portion may be formed by materials having different hardnesses (may be materials having the same charging row). That is, since the material having a low hardness is more liable to be deformed at a surface thereof than the material having a high hardness and an area of being brought into contact with the toner becomes large and therefore, at the portion having a low hardness, a friction force of the toner and therefore, a charging amount is reduced. Therefore, when the material having a low hardness is inserted and when the developing roller reaches a rectified number of times, the material is exposed to the surface, an advantage similar to that obtained by the first illustrative aspect can be achieved.

(2) Although according to the first illustrative aspect, a failure in charging is brought about by constituting the contact portion by the two materials having different charging properties (charging row with respect to acryl poses a problem), for example, by applying an inverse bias to a predetermined portion of the contact portion, the failure in charging may electrically be brought about to the toner T passing through the portion.

The foregoing description of the illustrative aspects has been presented for purposes of illustration and description. It is not intended to be exhaustive or to limit the invention to the precise form disclosed, and modifications and variations are possible in light of the above teachings or may be acquired from practice of the invention. The illustrative aspects were chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. A developing cartridge attachable to and detachable from an image forming apparatus that forms an image on a recording medium, the developing cartridge comprising:

a developer agent chamber that stores a developer agent of a nonmagnetic single component;

a developer agent carrier that supplies the developer agent to an electrostatic latent image formed on an image carrier provided in the image forming apparatus; and a layer thickness restricting member that has a contact portion that elastically contacts with the developer agent carrier and restricts a layer thickness of the developer agent carried on the developer agent carrier, wherein the contact portion includes a first layer that contacts with the developer agent carrier and a second layer covered by the first layer, the second layer being configured to be exposed by wearing of the first layer in accordance with rotation of the developer agent carrier and to be contacted with the developer agent carrier, wherein the first layer is configured to charge the developer agent by a friction when the developer agent passes between the first layer and the developer agent carrier, and wherein the second layer is configured to cause the developer agent into a failure in charging when the developer agent passes between the second layer and the developing agent carrier.

2. The developing cartridge according to claim 1, wherein the second layer includes a material having a friction charging characteristic lower than a friction charging characteristic of the first layer.

3. The developing cartridge according to claim 2, wherein the first layer includes a rubber member made of silicone, and wherein the second layer includes a rubber member made of a polyurethane.

4. The developing cartridge according to claim 1, wherein the second layer has a hardness lower than a hardness of the first layer.

5. The developing cartridge according to claim 1, wherein the layer thickness restricting member includes an arm member having a flexibly and the contact portion fixed to an end portion of the arm member to be opposed to the developer agent carrier, and wherein a portion of the arm member opposed to the contact portion is provided with a projected portion expanded to a side of the contact portion, the projected portion being provided with the second layer.

6. A developing cartridge attachable to and detachable from an image forming apparatus that forms an image on a recording medium, the developing cartridge comprising:

a developer agent chamber that stores a developer agent of a nonmagnetic single component;

a developer agent carrier that supplies the developer agent to an electrostatic latent image formed on an image carrier provided in the image forming apparatus; and a layer thickness restricting member that has a contact portion that elastically contacts with the developer agent carrier and restricts a layer thickness of the developer agent carried on the developer agent carrier, wherein the contact portion includes a first layer that contacts with the developer agent carrier and a second layer covered by the first layer, the second layer being configured to be exposed by wearing of the first layer in accordance with rotation of the developer agent carrier and to be contacted with the developer agent carrier, wherein the first layer serves as a layer thickness restricting layer that restricts the layer thickness of the developer agent to become a predetermined regular layer thickness when the developer agent passes between the first layer and the developer agent carrier, and wherein the second layer serves as a releasing layer that releases the layer thickness from being restricted.

7. The developing cartridge according to claim 6, wherein the releasing layer is a hollow portion that forms a hollow gap between the developer agent carrier when a surface layer of the contact portion is worn to be scraped in accordance with rotation of the developer agent carrier.

8. The developing cartridge according to claim 7, wherein the layer thickness restricting member includes an arm member having a flexibly and the contact portion fixed to an end portion of the arm member to be opposed to the developer agent carrier, and wherein a dimension of the hollow portion in a direction of a rotating axis of the developing agent carrier is set to be smaller than a dimension of the hollow portion in a direction of rotation of the developing agent carrier.

9. The developing cartridge according to claim 7, wherein the layer thickness restricting member includes an arm member having a flexibly and the contact portion fixed to an end portion of the arm member to be opposed to the developer agent carrier, wherein the hollow portion is formed in a recessed shape opened to a side being opposed to the arm member, and wherein a portion of the arm member in correspondence with the contact portion is provided with a hole communicated with an opening portion of the hollow portion.

10. The developing cartridge according to claim 7, wherein the developer agent chamber is provided on an upstream side in a direction of rotation of the developing agent carrier with respect to the layer thickness restricting member, wherein the image carrier is arranged on a downstream side in the direction of rotation of the developing agent carrier with respect to the layer thickness restricting member, and wherein the contact portion of the layer thickness restricting member is provided with a restricting portion that restricts the developer agent from flowing out from a side of the developer agent chamber to a side of the image carrier.

11. An image forming apparatus comprising:

an image forming section that forms an image on a recording medium, and is provided with an image carrier on which an electrostatic latent image is formed; and a developing cartridge attachable to and detachable from the image forming apparatus, wherein the developing cartridge comprises:

a developer agent chamber that stores a developer agent of a nonmagnetic single component;

a developer agent carrier that supplies the developer agent to the electrostatic latent image formed on the image carrier provided in the image forming apparatus; and a layer thickness restricting member that has a contact portion that elastically contacts with the developer agent carrier and restricts a layer thickness of the developer agent carried on the developer agent carrier, wherein the contact portion includes a first layer that contacts with the developer agent carrier and a second layer covered by the first layer, the second layer being configured to be exposed by wearing of the first layer in accordance with rotation of the developer agent carrier and to be contacted with the developer agent carrier, wherein the first layer is configured to charge the developer agent by a friction when the developer agent passes between the first layer and the developer agent carrier, and wherein the second layer is configured to cause the developer agent into a failure in charging when the developer agent passes between the second layer and the developing agent carrier.

12. An image forming apparatus comprising:

an image forming section that forms an image on a recording medium, and is provided with an image carrier on which an electrostatic latent image is formed; and a developing cartridge attachable to and detachable from the image forming apparatus, wherein the developing cartridge comprises:

a developer agent chamber that stores a developer agent of a nonmagnetic single component;

a developer agent carrier that supplies the developer agent to the electrostatic latent image formed on the image carrier provided in the image forming apparatus; and a layer thickness restricting member that has a contact portion that elastically contacts with the developer agent carrier and restricts a layer thickness of the developer agent carried on the developer agent carrier, wherein the contact portion includes a first layer that contacts with the developer agent carrier and a second layer covered by the first layer, the second layer being configured to be exposed by wearing of the first layer in accordance with rotation of the developer agent carrier and to be contacted with the developer agent carrier, wherein the first layer serves as a layer thickness restricting layer that restricts the layer thickness of the developer agent to become a predetermined regular layer thickness when the developer agent passes between the first layer and the developer agent carrier, and wherein the second layer serves as a releasing layer that releases the layer thickness from being restricted.

* * * * *